United States Patent [19]

Wolff

[11] 4,074,736

[45] Feb. 21, 1978

[54] MILLING GAUGE

[76] Inventor: Robert Wolff, 1 M Kiesacker, 5446 Engeln, Germany

[21] Appl. No.: 780,972

[22] Filed: Mar. 24, 1977

[30] Foreign Application Priority Data

May 15, 1976 Germany ..... 2621746
Sept. 24, 1976 Germany ..... 2642924

[51] Int. Cl.[2] ..... B27F 1/08

[52] U.S. Cl. ..... 144/78; 144/144.5 R; 33/174 G

[58] Field of Search ..... 144/87, 85, 144.5; 33/174 G

[56] References Cited

U.S. PATENT DOCUMENTS

| | | | |
|---|---|---|---|
| 1,651,510 | 12/1927 | Carter | 144/87 |
| 2,764,191 | 9/1956 | Hartmann | 144/87 |
| 3,109,466 | 11/1963 | Jones | 144/144.5 |
| 3,223,132 | 12/1965 | Erne | 144/144.5 |
| 3,800,840 | 4/1974 | McCord | 144/87 |

*Primary Examiner*—Donald R. Schran

[57] ABSTRACT

A milling gauge provided with slits and a guide piece for milling dovetail grooves into sheets or boards which are dovetailed together at right angles to each other. A milling cutter held by the guide piece is introduced into the slits of the gauge which is clamped with the board onto a work bench. The gauge has a body portion provided with counter guides for the guide piece. Two comb-like guide plates are formed in the body of the gauge and are oriented at right angles to each other thus giving the possibility to introduce the cutter in two different directions into the gauge body for cutting grooves in one board in its transversal direction and in another board in its longitudinal direction.

7 Claims, 6 Drawing Figures

I
25

5
9
24
36
II
25
6
10
3
37
4b
2
26
31
30
32
25

28
27

34
35
33
26
26'
Y
29
25
30

MILLING GAUGE

CROSS-REFERENCE TO RELATED APPLICATIONS

Reference is make to West German Patent application Nos. p 26 21 746.9 filed May 15, 1976 and P 26 42 924.3 filed Sept. 24, 1976 and priority under 35 USC 119 is claimed for these West German applications.

BACKGROUND OF THE INVENTION

A. Field of the Invention

The invention relates to a milling gauge for cutting dovetail grooves especially directed to the joining of rectangular boards or sheets which are to be joined by a dovetail gauge of the invention.

B. Description of the Prior Art

In the production of wooden furniture, desk or bureau drawers, wooden boxes and similar articles, it is generally customary to assemble two boards abutting with their ends against each other at a right angle by a so-called wedge joint. For this purpose, several dovetail grooves are milled into the ends of each board, whereby the wedges developed between two adjacent dovetail grooves must provide a cross-sectional shape which is congruent with the dovetail grooves.

In the case of one of these boards namely the so-called cross bar, the dovetail grooves must be oriented perpendicularly in relation to the plane of the board, while in the case of the other board namely the longitudinal board, the run is parallel to its main surfaces. Further, the grooves and wedges in the case of one of the boards must be displaced in a completely exact manner by always one half of the middle groove distance in relation to the grooves and wedges of the other board, so that the wedges of one board will fit into the proper grooves of the other board. Beyond this second requirement, the grooves must be distributed over the width of the board in such a way that the half or residual wedges are of a sufficient width and stability where they are left at the longitudinal edges of the board.

Although instructions are available and special and costly machines are available to the manufacturers of furniture and wooden boxes, there has been very little choice of special gauges for the amateur carpenter or cabinetmaker.

For do-it-yourself and home carpenters who generally have only one electric hand drill or drilling cutter available, it is exceedingly difficult and time consuming to accomplish the necessary calcualtions and measurements whereby it also causes the do-it-yourselfer the greatest of difficulties to cut out the grooves with the required precision of their position.

OBJECTS OF THE INVENTION

The invention is based on the object of creating a reasonably priced milling gauge suitable for do-it-yourselvers for the above mentioned purpose, the weight and dimensions for which are kept small and which is simple in its handling.

Another object of the invention is to provide a milling gauge for the milling of dovetail grooves in the case of boards that are to be put together at right angle by means of a milling cutter which is to be kept in a guide piece which is introduced into the slots of a comblike gauge body and which can be clamped together with the board onto a work bench and wherein the gauge body is provided with counter guides for the guide element.

Other and further objects will be seen from the following description and attached drawings.

SUMMARY OF THE INVENTION

In order to solve the task of the invention, the body of the gauge comprises two comblike guide plates whicch are mutually oriented at right angles to each other and which pass or merge into each other at the ends of their prongs so as always to be aligned with one another. According to a preferred embodiment of the invention, the body of the gauge is a part of a U-shaped C-clamp, whereby the two guide plates are the contact surfaces for a board that is to be clamped down. Counter guides are provided on the gauge to serve as spacing means for a guide piece.

As a result of achieving the object of the invention, a number of advantages will be achieved. First, the milling gauge that is to be clamped to the work bench - apart from the clamp down screw - is made of one piece which very much simplifies both its manufacture and its manipulation. Secondly, there are no longer any free ends of wedges, since the wedges of the two comblike guide plates pass over into each other and are thus supported on both ends within the body of the gauge. In order to achieve a sufficient stability of the freely projecting wedges sufficient for the absorption of the guide wedges, the body of the gauge according to the invention may be produced as a light metal casting, as a result of which considerable cost and savings in weight will be achieved. A further considerable advantage of the milling gauge consists of the fact that one can immediately recognize the manner in which it is to be handled which, particularly within the scope of a do-it-yourself program is of decisive importance for promoting sales. In summary, a very practical and reasonable priced milling gauge for the above mentioned purpose is created by the present invention.

In a special development of the invention, provision may be made that the guide piece at its lower front end which is to be placed onto the pertinent guide place, has a guide rib which may be inserted into the guide slits and which in its cross section is T-shaped, the transverse leg of which always reaches behind the adjacent wedges, and in that the wedges of each guide plate are provided with transverse grooves in the form of corner recesses with which the transverse grooves are always aligned. The guide piece in this case may always have a guide rib on either side of the milling cutter, as a result of which the precision of the guidance is increased.

In a further development of the invention, provision may be made that one of the guide ribs carry a spindle projecting away opposite to its direction of sliding in, on which a stop nut is disposed adjustable in order to limit the length of the groove that is to be cut. Effectively, the spindle is provided at its free end with a handle.

BRIEF DESCRIPTION OF THE DRAWING

The milling gauge of the invention will be explained in more detail on the basis of the preferred embodiment shown in the drawing.

DESCRIPTION OF THE PREFERRED EMBODIMENT

Figures 1, 2, 3:
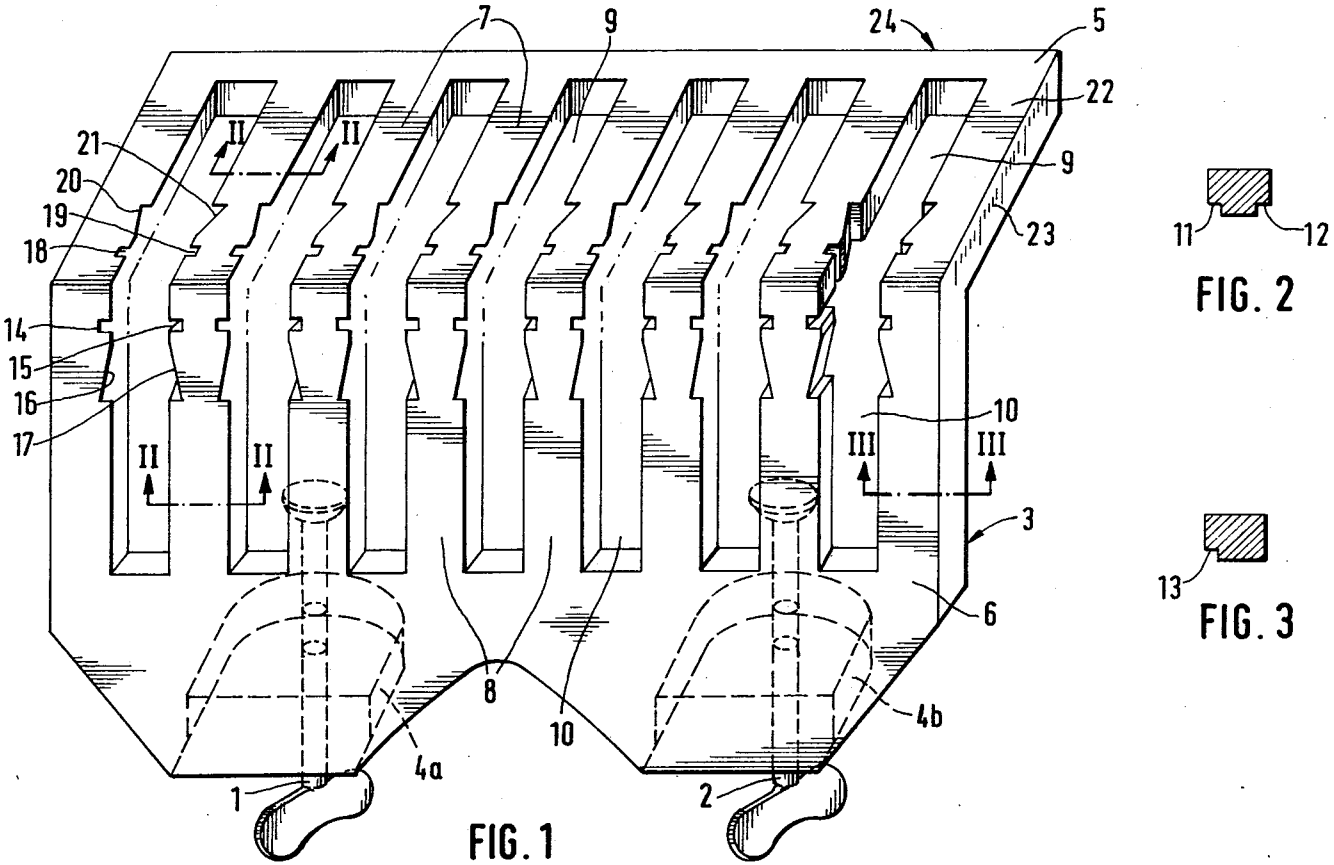
FIG. 1 is a perspective view of the gauge body which is part of the milling gauge according to the invention.
FIG. 2 shows a sectional view along the lines of intersection II—II in FIG. 1.
FIG. 3 shows a sectional view according to the lines of intersection III—III in FIG. 1.
Figures 4, 5, 6:
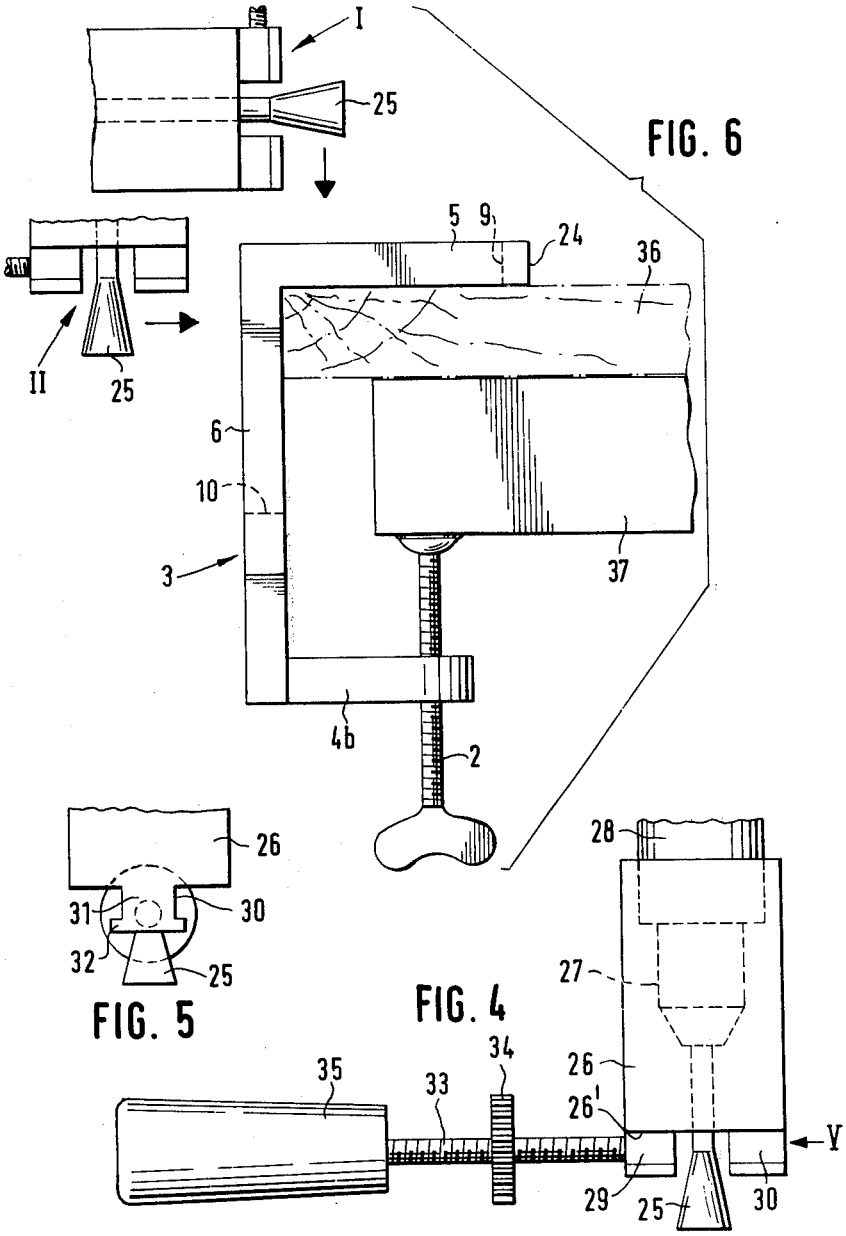
FIG. 4 shows a guide piece attached to the cutter and the guide piece represents part of the milling gauge.
FIG. 5 is a partial view of the guide piece in FIG. 4 viewed in the direction of the arrow V.
FIG. 6 shows a schematic view for the explanation of the method of handling the milling gauge.

The milling gauge body in the side view is shown in FIG. 1 and also is shown in FIG. 6 and is in the basic form of a U-shaped C-clamp 3 which has two parallel clamping screws 1,2. The U-shaped body of the clamp at the same time constitutes the body of the gauge 3 and is made in one piece from die cast zinc or die cast light metal. The one leg of the clamp following the guide leg of the screws 4*a*, 4*b* and the other leg of the clamp opposite the screws 1, 2 are developed as comb-like guide plates 5 and 6. These plates 5 and 6 are provided with prongs 7 and 8 which pass into one another and are also provided with slits 9 and 10 between the prongs 7 and 8, said slits merge in alignment at the corner of the comb-like body portion of the milling gauge.

In the case of each guide plate 5 or 6, the corresponding prongs 7 and 8 are disposed equi-distant and they each have a width which is always equal to the width of the guide slits 9 and 10 which are enclosed by them. The prongs 7 and 8 are provided with longitudinal grooves in the form of corner recesses 11, 12 and 13 on the longitudinal edge lying in the angular area of the body 3 of the gauge in particular see the sectional views according to FIGS. 2 and 3 for these grooves 11, 12, and 13. U-shaped transverse grooves 14 and 15 serves as counter guides and are aligned with the corner recesses 11, 12 and 13 of the prongs 7 of guide plate 5 and are also aligned with the prongs 8 on the guide plate 6 or on its prongs 8. Lying somewhat below, the dovetails 8 are provided with triangularly shaped transverse grooves 16 and 17 which always allow adequate space for the introduction of a milling cutter having the shape of a truncated cone. Analogously, the prongs 7 of the guide plate 5 are provided with transverse grooves 18, 19, which are always aligned with corner recesses 11, 12 and 13 of the prongs 8. On the prong 7, the triangular grooves 20, 21 are provided for the introduction of the milling head. In FIG. 1, the grooves 14 to 21 are shown completely in perspective only in the area of the right-hand guide slits 9, 10 while in the case of the remaining slits of FIG. 1 the grooves are indicated only by their inside contour.

The prong 22 at the edge of the guide plate 5 is provided with a metric scale 23 at its outside which is used for the determination of the length of the groove in the case of the rectangular or longitudinal board that constitutes the workpiece which is to be provided with grooves in its longitudinal direction, in the manner which will be explained in greater detail later on. The guide plate 5 is likewise provided on its outside 24 on the back of its comb with a millimeter scale.

FIGS. 4 and 5 show the milling tool 25 in registry with the assigned guide piece 26. As schematically shown, milling tool 25 is clamped into drill chuck 27 of the electric drill used by a do-it-yourself user. The do-it-yourself user can so clamp the tool 25 in relation to the guide piece 26 so that guide piece 26 is rigidly attached to the housing of the drill. The guide piece 26 at its lower front surface 26' has two mutually aligned guide ribs 29, 30 which are T shaped in their cross section and which enclose the milling tool 25 between them. The upper vertically directed leg 31 of the guide ribs 29, 30 has a width which is approximately equal to the width of the guide slits 9, 10 of the body of the gauge. Its height is always equal to the distance between the transverse grooves 14, 15 of the guide plate 6 and the top side of the other guide plate 5, respectively equal to the distance between the transverse grooves 18, 19 in the guide plate 5 and the front side of the guide plate 6. The transverse leg 32 located below fits with a slight guide clearance in the pair of transverse grooves 14, 15 or grooves 18 and 19 which are opposite each other.

On the front side of the guide rib 29 and facing away from the milling tool 25, a threaded spindle 33 is attached. On spindle 33, the threads of a knurled thumb nut 34 is fitted and is adjustable by threaded engagement or disengagement. The spindle 33 has a handle 35 on its free end.

The method of handling the milling gauge is illustrated in FIG. 6. First one of the two boards, for example, the transverse board 36, which is to be milled and given a groove in a transverse direction, is clamped down on workbench 37 so that the board 36 is held with its front end that is to be processed fitting against the guide plate 6. At the same time, the board 36 and the body 3 of the gauge are aligned with one another perpendicularly to the plane of the drawing of FIG. 6 in such a way so that at the longitudinal edges of the board there are milled suitable residual dovetails and residual grooves which are located at the longitudinal edges of the board. Subsequently, the milling tool is introduced in the position designated by I and as a result of successive movements in the vertical direction into the slits 10 of the guide plate 6 the wedge-shaped dovetails are developed by milling in the board 36 over its entire width.

Subsequently, the other board that is to be grooved in a longitudinal direction is clamped down on the workbench 37 in the same longitudinal orientation as the board 36. However, now the displacement of the board and the body 3 of the gauge is in a direction contrary to the clamping of the first board, and the displacement is to a degree of the width of one guide slit 9 and 10. In order to determine the amount of the displacement, use is made of the metric scale 24 from which the clamping position of the first board is read. Subsequently, the milling tool 25 is introduced in its vertical position designated by II in FIG. 6, and in accordance with the showing of FIG. 2. The milling tool cuts along the horizontally directed slits 9 of the upper guide plate 5 and at the same time the longitudinal grooves are produced in the other board. The knurled nut 34 in this case is adjusted in such a way on the threaded spindle 33 that it will strike against plate 6 upon reaching the desired length of the groove and in this fashion, acts as a stop.

Having thus disclosed the invention, I claim:

1. A milling gauge for milling dovetail grooves in boards that are to be dovetailed together at right angles by means of a milling cutter hand machine comprising:

a gauge body having a comb-like body portion provided with parallel slits and prongs;

a guide piece which is attachable to the milling cutter hand machine and is to introduce into said slits of the comb-like body portion;

said gauge body being clamped together with one board to a workbench;

counter guides on said gauge body which serve as spacing means for said guide piece; and, said comb-like body portion has two comb-like guide plates which are oriented at right angles to one another;

2. A milling gauge as claimed in claim 1, wherein said gauge body is in the form of a U-shaped C-clamp and said two guide plates constitute the contact surfaces of the gauge for pressing engagement with a board that is to be clamped for the milling step by the milling cutter.

3. A milling gauge as in claim 2 wherein said guide piece is provided on its lower front surface which is placed onto the guide plate with a projecting guide rib having guide slits;

said guide rib being insertable into said parallel slits of said guide plates and has a cross section which is T-shaped, the transverse leg of the T-shape reaching behind the adjacent prongs and wherein the prongs of each guide plate are provided with transverse grooves defining said counter guides for the reception of the transverse leg of the T-shape of the guide rib during the insertion into the slits of the other of the two guide plates.

4. A milling gauge as in claim 3 wherein the prongs are provided on their inside longitudinal edges with longitudinal grooves in the form of corner recesses with which the transverse grooves are aligned.

5. A milling gauge as in the claim 4, wherein said guide piece has a guide rib on each side of the milling cutter tool.

6. A milling gauge as in the claim 5, wherein one of the guide ribs carries a threaded spindle projecting opposite to its direction of its insertion and a stop nut is disposed on said spindle, stop nut being adjustably fitted by its threaded in order to limit the length of the groove that is to be milled.

7. A milling gauge as in claim 5 wherein the spindle is provided with a handle at its free end.

* * * * *